US005692828A

United States Patent [19]

Chung

[11] Patent Number: 5,692,828

[45] Date of Patent: Dec. 2, 1997

[54] GARDEN LAMP

[76] Inventor: Lee Hsin-chih Chung, No. 21-8, Shang san cho woo, Wuchang-li, Chungli City, T'ao Yuan Hsien, Taiwan

[21] Appl. No.: 695,302

[22] Filed: Aug. 9, 1996

[51] Int. Cl.[6] ..... F21S 1/10

[52] U.S. Cl. ..... 362/431

[58] Field of Search ..... 362/431

[56] References Cited

U.S. PATENT DOCUMENTS 5,504,397 4/1996 Chieh ..... 362/431

*Primary Examiner*—Carroll B. Dority
*Attorney, Agent, or Firm*—Beveridge, DeGrandi, Weilacher & Young LLP

[57] ABSTRACT

A garden lamp includes a lamp body made of a light transmission material with a bulb fixed therein and having a bore with an opening in which rigid, conductive spikes in connection with the bulb are fixed and a post having a sharpened lower end to pierce into the ground and a top end for receiving thereon the bore of the lamp body. The post includes a hollow central section connecting between the lower end and the top end with the top end rotatable relative to the central section about a common axis. An upward convex arcuate groove is provided on the top end of the post to receive and hold therein wires. Two pegs respectively extend radially from the top end and the central section of the post. The bore of the lamp body has a straight slot and an inclined slot provided on an inside surface thereof with the inclined slot extending upward from the straight slot so as to allow the lamp body to be fit onto and secured on the top end of the post by having the pegs received within the straight slot to such a location where the peg on the central section is allowed to move into the inclined slot by relative rotation between the top end and the central section of the post. The central section has two lower openings and two upper openings to allow wires to extend therethrough.

6 Claims, 5 Drawing Sheets

GARDEN LAMP

FIELD OF THE INVENTION

The present invention relates generally to a garden lamp.

BACKGROUND OF THE INVENTION

Houses with backyards and/or gardens are preferred by city residents. Usually, people like to install lighting devices in the backyard/garden for illumination and decoration purposes. In FIG. 5 of the accompanying drawings, a garden lamp for such purposes is shown. The conventional garden lamp that is shown in FIG. 5 generally comprises an anchoring post 10 on which a lamp body 20 is fixed. The anchoring post 10 comprises a sharpened lower end for piercing into soil ground and a grooved upper end which has a groove 11 formed on each of two opposite sides thereof and extending axially from the top end of the post 10 and terminating at a pre-determined length of the post 10 from the top end to define wire channels for receiving and holding therein wires (not shown) that supply electricity to the lamp body 20. A substantially flat top face 12 is provided on the top end of the post 10 between the two grooves 11 for supporting a portion of the wires thereon.

The lamp body 20 is basically a hollow member made of a light transmission material with a light source, such as a bulb (not shown) fixed therein. A lower opening 21, preferably in the form of a hollow cylinder, is provided on the lamp body 20 to fit onto and fix on the top end of the post 10. Rigid conductive sparks (not shown in FIG. 5, but similar to the element designated with reference numeral 31 in FIG. 2) which are in electrical connection with the bulb are provided within the opening 21 and corresponding to the flat top face 12 so that when the lamp body 20 is fit onto the top end of the post 10, the spikes penetrate the insulation outer layers of the wires to establish electrical connection between the conductor cores of the wires and the bulb.

A disadvantage of the conventional garden lamp is that the penetration of the spikes into the wires is done forcibly and in a un-controlled manner so that the desired electrical contact between the spikes and the conductor cores of the wires may not be properly achieved.

Further, the wires are loosely received within the grooves 11 and the wires are allowed to move on the top face 12 so that in order to properly pierce the spikes into the wires, the wires have to be securely held by hand in mounting the lamp body 20 to the post 10. A great chance of mis-penetrating the spikes into the wires exists. Besides, tightly holding the wires with hands in mounting the lamp body 20 to the post 10 may cause fatigue of the hands.

SUMMARY OF THE INVENTION

An object of the present invention is to provide a garden lamp of the above-described type, wherein the penetration of the spikes into the wires is done in a controlled manner.

Another object of the present invention is to provide a garden lamp of the type described above where no hand-holding of the wires is needed during the assembly of the lamp.

A further object of the present invention is to provide a garden lamp structure wherein the piercing post is provided with a hollow central section for receiving, holding, shielding and protecting wires therein.

To achieve the above objects, there is provided a garden lamp comprising a lamp body made of a light transmission material with a bulb fixed therein and having a bore with an opening in which rigid, conductive spikes in connection with the bulb are fixed and a post having a sharpened lower end to pierce into the ground and a top end for receiving thereon the bore of the lamp body. The post comprises a hollow central section connecting between the lower end and the top end with the top end rotatable relative to the central section about a common axis. An upward convex arcuate groove is provided on the top end of the post to receive and hold therein wires. Two pegs respectively extend radially from the top end and the central section of the post. The bore of the lamp body has a straight slot and an inclined slot provided on an inside surface thereof with the inclined slot extending upward from the straight slot so as to allow the lamp body to be fit onto and secured on the top end of the post by having the pegs received within the straight slot to such a location where the peg on the central section is allowed to move into the inclined slot by relative rotation between the top end and the central section of the post. The central section has two lower openings and two upper openings to allow wires to extend therethrough.

These and other objects and advantages of the present invention will become more apparent from a consideration of the following detailed description of a preferred embodiment thereof, when read in conjunction with the accompanying drawings, wherein:

DETAILED DESCRIPTION OF THE PREFERRED EMBODIMENT

Figure 1:
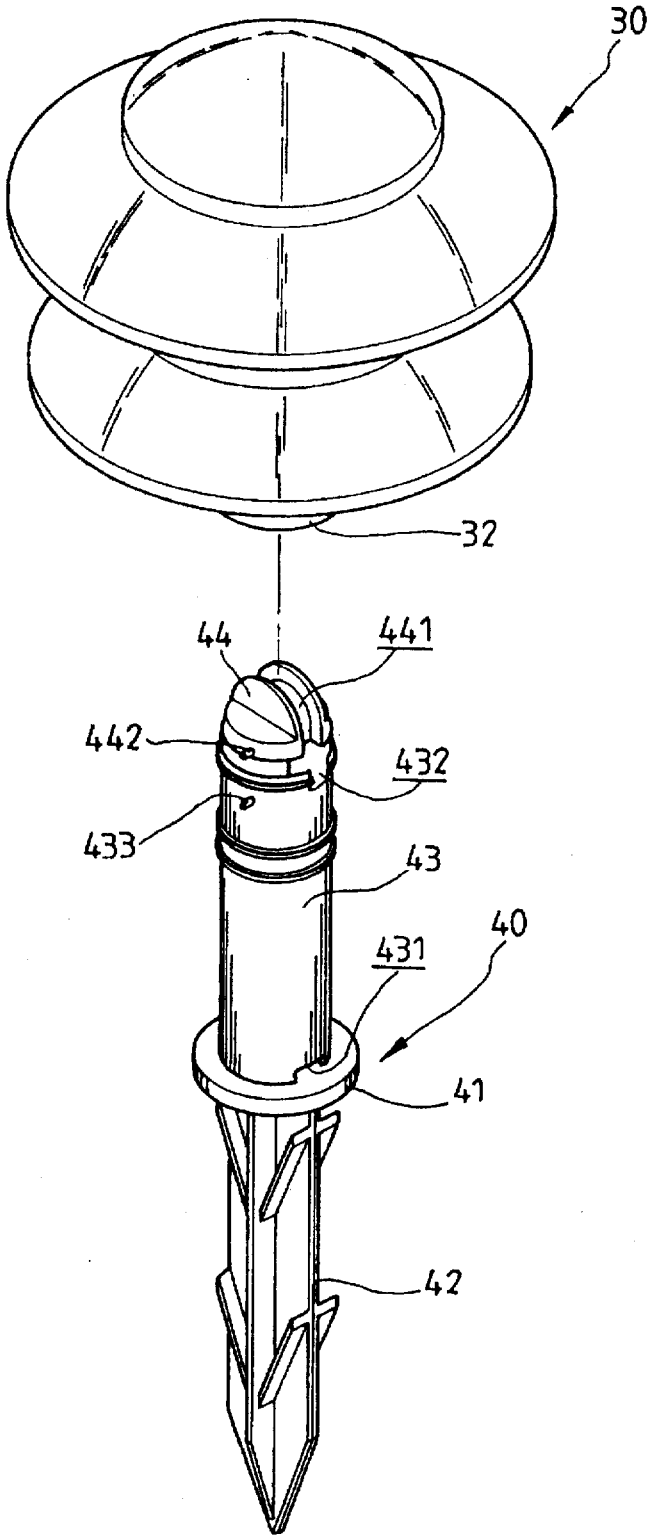
FIG. 1 is an exploded perspective view showing a garden lamp constructed in accordance with the present invention.

Referring to the drawings and in particular to FIG. 1, wherein a garden lamp constructed in accordance with the present invention is shown, the garden lamp of the present invention comprises a post 40 and a lamp body 30 mounted to top end of the post 40.

The post 40 comprises a sharpened piercing lower end or tip 42 adapted to pierce into soil ground, a hollow central section 43 which is fixed to the lower tip 42 with a circumferential ring or flange 41 fixed therebetween and a top end member 44 rotatably fit into a top end of the central section 43. The circumferential flange 41 serves to hold the central section 43 and the top end member 44 above the ground when the piercing lower tip 42 penetrates into the ground. Two lower openings 431 of which only one is visible in FIG. 1 are provided on the central section 43 at lower side of the central section 43 and two corresponding upper openings 432 of which only one is visible in FIG. 1 are also provided on the upper side of the central section 43.

The top end member 44 has an upward convex, arcuate slot or groove 441 formed thereon. The groove 441 is convex and defines an apex of the post 40. The top end member 44 is so located and oriented relative to the central section 43 that two ends of the arcuate groove 441 are corresponding in position to the two upper openings 432 of the central section 43. A wire channel is thus defined by a first one of the lower openings 431, interior of the hollow central section 43, the corresponding one of the upper openings 432, the arcuate slot 441, a second one of the upper openings 432, the interior of the central section 43 and a second one of the lower openings 431, see FIGS. 3 and 4. The wire channel so defined allows an electric wire 50 to extend to and through the arcuate slot 441 through the interior of the central section 43 with a portion thereof located and held within the arcuate groove 441.

Both the central section 43 and the top end member 44 have a peg 433 and 442 formed thereon and extending in a radial direction. The two pegs 433 and 442 are aligned to each other in axial direction when the top end member 44 is located and oriented as described above to have the arcuate groove 441 matching the upper openings 432 of the central section 43.

Figure 2:
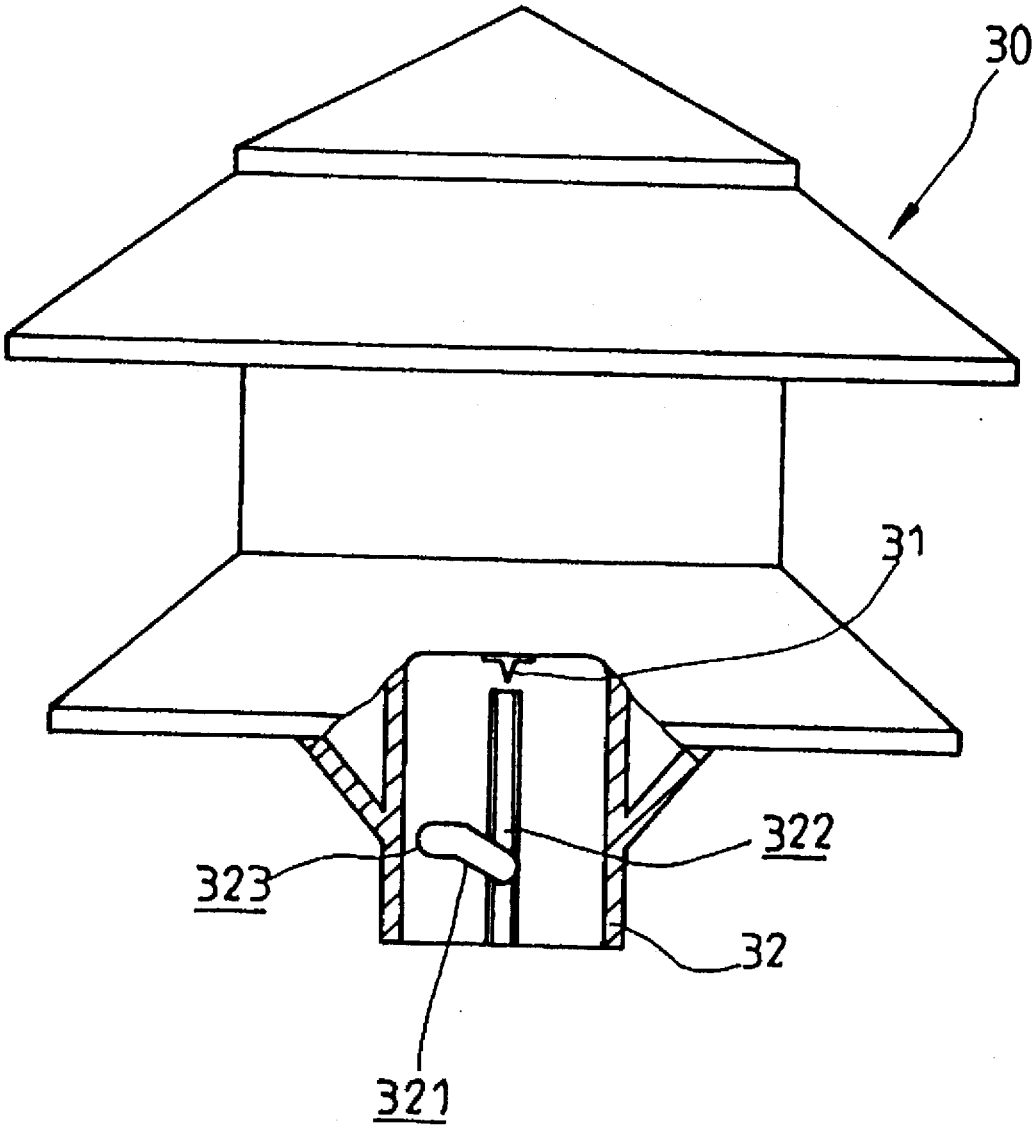
FIG. 2 is a side elevational view of the lamp body, partially broken to show inside structure of the supporting cylinder.

Also referring to FIG. 2, the lamp body 30 comprises a hollow body inside which a light source, such as a bulb (not shown) is fixed. A bore preferably in the form of a cylinder 32 having an opening is formed on the hollow body 30 and dimensioned to fit over the top end member 44 and a portion of the central section 43 of the post 40. Spikes 31 which are made of rigid conductive material and in electrical connection with the bulb are provided within the cylinder 32 at such a location that when the cylinder 32 is fit over the top end member 44 and a portion of the central section 43 of the post and moved toward the lower tip 42 of the post 40, the spikes 31 are brought into contact with the portion of the wires 50 located within the arcuate groove 441 and capable to pierce into the wires 50 with a further movement of the lamp body 30 relative to the post 40.

On an inside surface of the cylinder 32, a vertical or axial slot 322 is provided, extending from lower edge of the cylinder 32 to a pre-determined length. An inclined slot 321 is also provided on the cylinder 32 and in communication with the vertical slot 322 so that the inclined slot 321 extends upwards at a desired angle from a lower end thereof which corresponds to the connection of the inclined slot 321 with the vertical slot 322 in inclined manner to reach an upper end thereof at a pre-determined distance from the connection therebetween (or the lower end thereof). Preferably, a horizontal extension 323 of the inclined slot 321 is provided at the upper end of the inclined slot 321.

Figure 3:
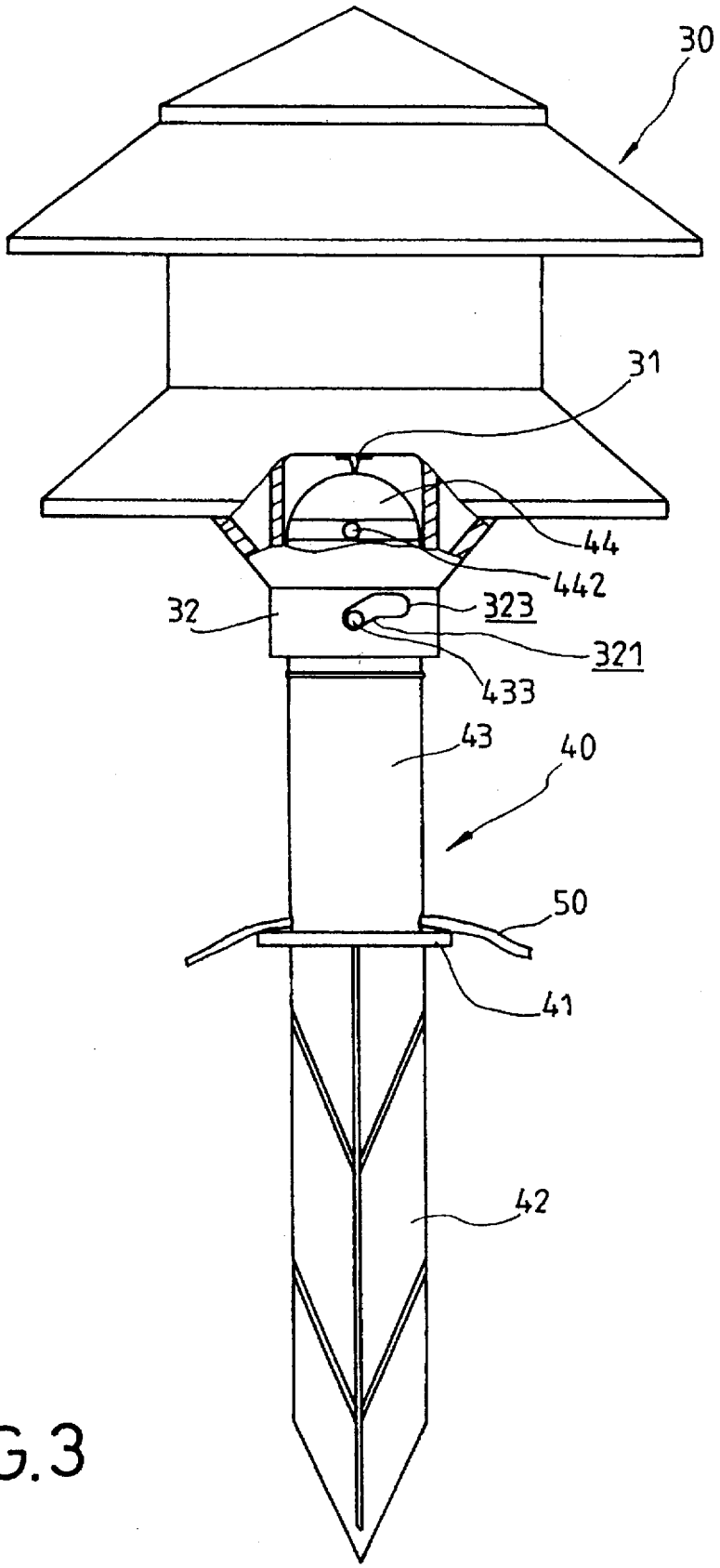
FIGS. 3 and 4 are side elevational view of the garden lamp in accordance with the present invention, with a portion thereof broken to show the mounting of the lamp body to the post.
Figure 4:
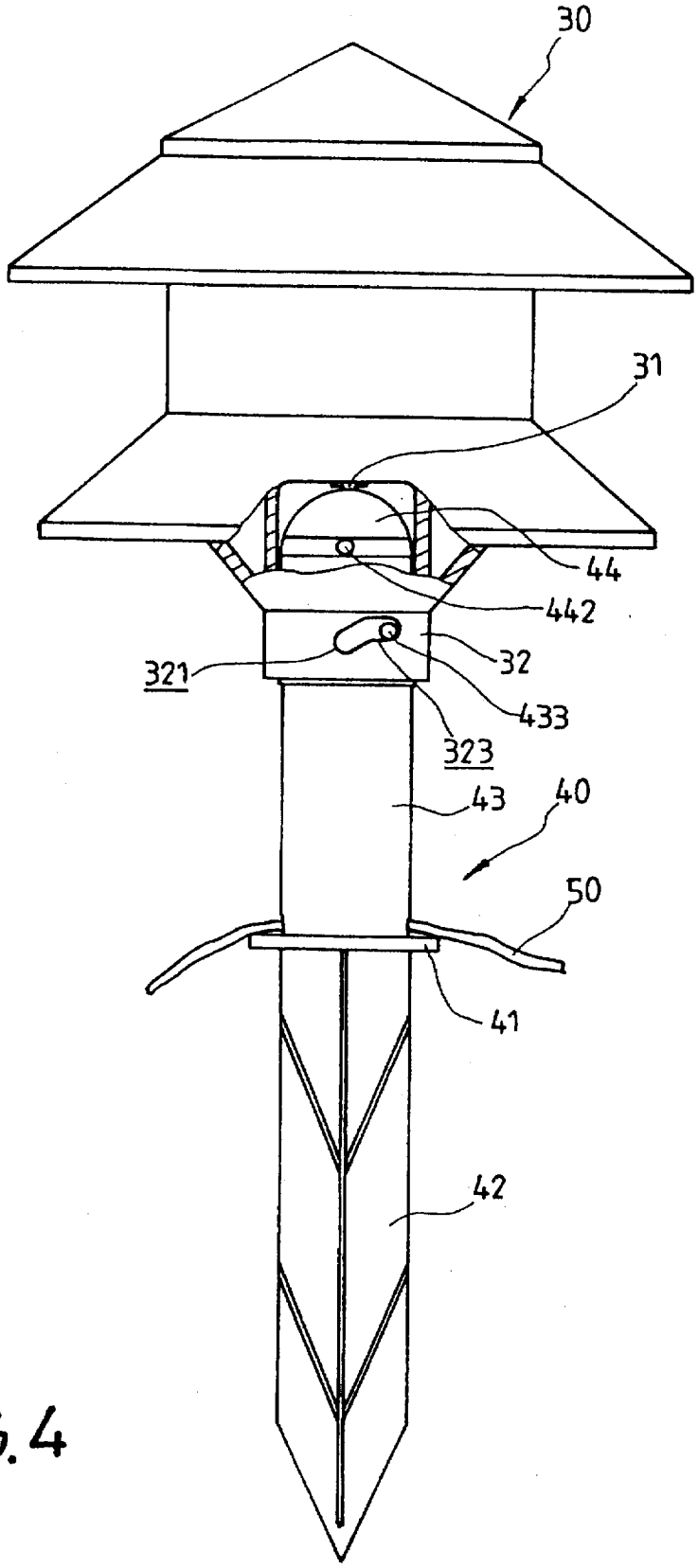
Figure 5:
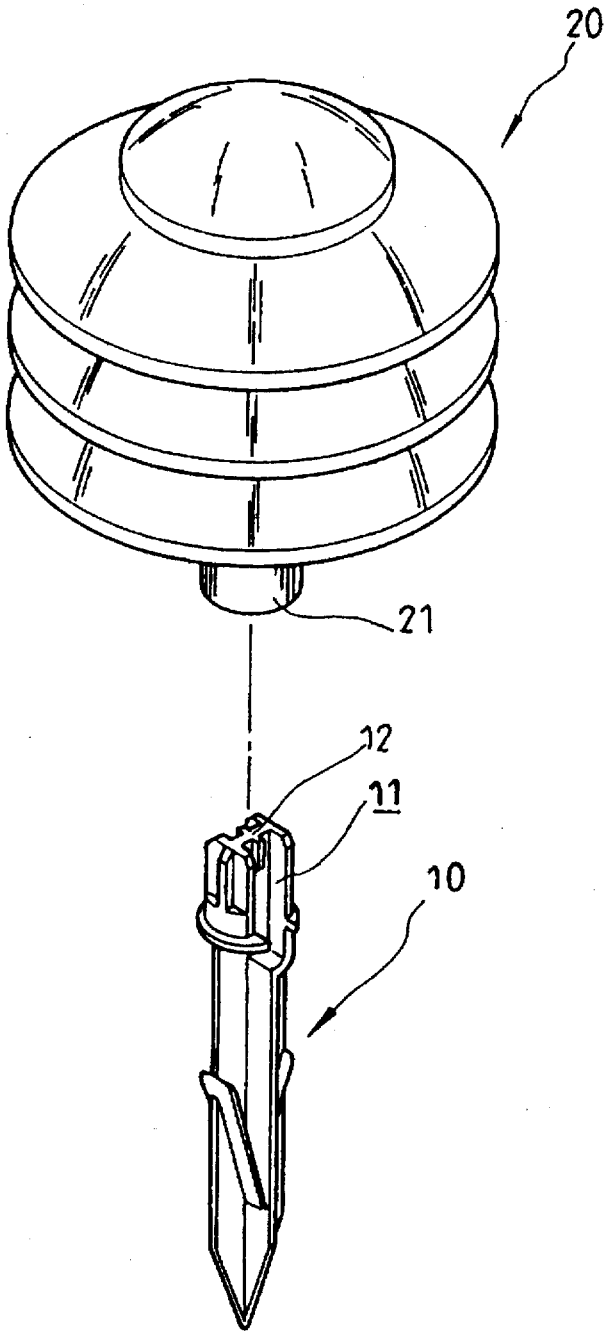
FIG. 5 PRIOR ART
FIG. 5 is an exploded perspective view showing a prior art garden lamp structure.

The length of the vertical slot 322 and location of the inclined slot 321 relative to the vertical slot 322 and distance between the two pegs 442 and 433 are such that in fitting the lamp body 30 onto the post 40, the pegs 442 and 433 are received into the vertical slot 322 and moved along the vertical slot 322 with the relative movement of the lamp body 30 with respect to the post 40 to such a location where the spikes 31 are brought into contact engagement with the wires 50, as shown in FIG. 3. At this point, the peg 433 is located at the connection between the vertical slot 322 and the inclined slot 321. By rotating the central section 43 of the post 40 relative to the top end member 44 on which the peg 442 is mounted, due to the fact that the peg 442 is prevented from rotation by the vertical slot 322, the peg 442 is held fixed while the peg 433 that is fixed on the central section 43 moves into the inclined slot 321 with the rotation of the central section 43. The inclination of the inclined slot 321 forces the peg 433, and thus the central section 43 of the post 40, to move upward relative to the cylinder 32 of the lamp body 30. This forces the lamp body 30 to further move toward the lower tip 42 of the post 40 and by the force of interaction between the peg 433 and the inclined slot 321, the spikes 31 are gradually forced to penetrate into the wire 50 and eventually establish an electrical connection with conductor cores of the wire 50 when the peg 433 reaches the horizontal extension 323 of the inclined slot 321, see FIG. 4.

With such an arrangement, the spikes 31 can be very reliably driven to penetrate into the wires 50 and establish a firm electrical engagement with the conductor cores of the wires 50.

Those skilled in the art will readily recognize that various modifications of the present invention may be made without departing the scope of the present invention defined in the appended claim. Accordingly the preferred embodiment illustrated and discussed herein should be understood to be exemplary only in nature and the scope of the instant invention should be limited only by the following claims.

What is claimed is:

1. A garden lamp comprising:

a lamp body at least partially light transmittable, adapted to receive and hold therein a light source, the lamp body having a bore that has an axis extending into the lamp body formed thereon in which spikes made of a rigid, electrically conductive material are provided to be in electrical connection with the light source, the bore having an opening and an inside surface on which a first slot extending from the opening thereof to a pre-determined length and a second slot extending from the first slot in an upward inclined manner to reach a pre-determined upper position; and a post having an axis and comprising a sharpened lower end adapted to pierce into the ground, a top end for receiving thereon the lamp body with the axis of the post substantially coincident with the axis of the bore of the lamp body and a central section connecting between the top end and the lower end with the top end rotatable relative to the central section about the axis of the post, the top end comprising an upward convex, arcuate groove having two ends for receiving and holding therein electrical wire having conductive cores enclosed by insulation outer layer so that when the lamp body is fit onto the top end of the post, the spikes are brought into contact with the outer layer of the wire, the top end having a first peg radially extending therefrom with respect to the axis and the central section having a second peg radially extending therefrom with respect to the axis to be receivable within the first slot of the lamp body to such a location where the second peg is allowed to move into the second slot and by rotation of the central section of the post relative to the top end, the second peg is moved into the second slot and forced upward by the inclination of the second slot so as to have the spikes penetrate through the outer layer of the wire to establish electrical connection with the conductive cores of the wire.

2. The garden lamp as claimed in claim 1, wherein the second slot comprises an extension located at the upper position and extending in a direction substantially transverse to the axis of the post.

3. The garden lamp as claimed in claim 1, wherein the central section comprises a first passage having a lower opening and a top opening corresponding one of the ends of the groove of the top end of the post to allow the wire to extend through the first passage via the lower and top openings to enter the groove through the end of the groove, the central section further comprises a second passage having a lower opening and a top opening to allow the wire from the groove at the second end thereof to extend through the second passage via the top and lower openings of the second passage.

4. The garden lamp as claimed in claim 3, wherein the central section comprises a hollow body having an interior space defining the first and second passages.

5. The garden lamp as claimed in claim 1, wherein the lamp body comprises a cylindrical extension defining the bore.

6. The garden lamp as claimed in claim 1, wherein the post comprises a circumferential flange fixed between the lower end and the central section.

* * * * *